US011028544B2

(12) United States Patent
Steele

(10) Patent No.: US 11,028,544 B2
(45) Date of Patent: Jun. 8, 2021

(54) INDESTRUCTIBLE MAILBOX POST

(71) Applicant: Timothy Allen Steele, Baldwin, MI (US)

(72) Inventor: Timothy Allen Steele, Baldwin, MI (US)

( * ) Notice: Subject to any disclaimer, the term of this patent is extended or adjusted under 35 U.S.C. 154(b) by 0 days.

(21) Appl. No.: 16/458,689

(22) Filed: Jul. 1, 2019

(65) Prior Publication Data

US 2020/0018024 A1 Jan. 16, 2020

Related U.S. Application Data

(60) Provisional application No. 62/696,550, filed on Jul. 11, 2018.

(51) Int. Cl.
*E01F 9/638* (2016.01)
*E04H 12/18* (2006.01)

(52) U.S. Cl.
CPC ..... *E01F 9/638* (2016.02); *E04H 12/18* (2013.01)

(58) Field of Classification Search
CPC ..... E01F 9/638; E04H 12/18
USPC ..... 52/848
See application file for complete search history.

(56) References Cited

U.S. PATENT DOCUMENTS 132,133 A * 10/1872 Bliss ..... E05F 1/1016 16/76
1,753,506 A * 4/1930 Florine ..... A47G 29/1216 248/145
2,283,607 A * 5/1942 Ludwig ..... B60T 17/008 181/237
2,949,324 A * 8/1960 Birge ..... E01F 9/627 403/229
3,646,696 A * 3/1972 Sarkisian ..... E01F 9/688 40/602
4,373,464 A * 2/1983 Blau ..... F16F 3/10 116/63 R
D290,822 S * 7/1987 McEntee ..... A45B 9/04 D11/166
4,759,161 A * 7/1988 Kucyk, Jr. ..... E01F 9/635 404/10
4,806,046 A * 2/1989 Clark ..... A63C 19/062 40/608
5,029,783 A * 7/1991 Alvarez ..... A47G 29/1216 232/39
5,307,598 A * 5/1994 West ..... A47G 29/1216 232/39

(Continued)

FOREIGN PATENT DOCUMENTS

DE 9301135 U1 * 3/1993 ..... E01F 9/627
DE 10016702 A1 * 10/2001 ..... E01F 9/627

*Primary Examiner* — Patrick J Maestri
*Assistant Examiner* — Joseph J. Sadlon
(74) *Attorney, Agent, or Firm* — Dunlap Bennett & Ludwig, PLLC; Brendan E. Squire

(57) ABSTRACT

An indestructible mailbox post includes a lower post that is buried in the ground surface and may be secured in the ground with a concrete or other material. The lower post is buried to a depth such that a spring element, interposed between the lower post and an upper post is positioned proximal, and preferably slightly above the ground surface. With the upper post coupled to the lower post via the spring element the upper post is free to flex about the spring element when acted upon by a force to preclude breakage of the post.

10 Claims, 2 Drawing Sheets

(56) References Cited

U.S. PATENT DOCUMENTS

| | | | | | |
|---|---|---|---|---|---|
| H1588 | H * | 9/1996 | Arney | B60T 17/008 | 343/715 |
| 5,803,647 | A * | 9/1998 | Hughes | E04F 11/1836 | 256/65.15 |
| 6,267,529 | B1 * | 7/2001 | Mudryk | E01F 9/629 | 116/63 R |
| 6,371,465 | B1 * | 4/2002 | Willis | F16F 1/06 | 267/166 |
| 6,494,636 | B1 * | 12/2002 | Mozena | A63C 11/221 | 403/109.2 |
| 6,810,890 | B2 * | 11/2004 | Lin | A45B 17/00 | 135/16 |
| 6,844,495 | B2 * | 1/2005 | Pastuch | F21V 21/12 | 174/135 |
| 6,969,212 | B1 * | 11/2005 | Richens | E01F 9/629 | 404/10 |
| 7,270,138 | B2 * | 9/2007 | Liao | A45B 9/04 | 135/82 |
| 9,433,313 | B2 * | 9/2016 | Lenz, Jr. | A47G 29/1216 | |
| 9,490,525 | B2 * | 11/2016 | Harmelink | H01Q 1/20 | |
| 10,022,611 | B2 * | 7/2018 | Oh | A63C 19/08 | |
| 10,605,290 | B1 * | 3/2020 | Roskwitalski | F16B 31/021 | |
| 2017/0350159 | A1 * | 12/2017 | Tuthill | E04H 17/22 | |
| 2018/0010308 | A1 * | 1/2018 | Mandal | E01F 9/627 | |

* cited by examiner

INDESTRUCTIBLE MAILBOX POST

CROSS-REFERENCE TO RELATED APPLICATION

This application claims the benefit of priority of U.S. provisional application No. 62/696,550, filed Jul. 11, 2018, the contents of which are herein incorporated by reference.

BACKGROUND OF THE INVENTION

The present invention relates to mailboxes, and more particularly to posts for mounting a mailbox in the ground.

Many home and property owners have the displeasure of having to replace their mailbox posts. In some instances, the placement of the mailbox near the driveway often leads to damage due to the movement of vehicles in and out of the driveway. In other instances, particularly in Northern regions, their placement near the street, so that postal carriers can deliver the mail presents an additional hazard. When snow is plowed from the streets, the mounds of snow driven by the plow may also be forced against the mailbox post. In some cases, the post is driven off its vertical orientation. In other cases, the post is snapped due to the forces involved.

As can be seen, there is a need for a mailbox post that is not damaged when acted on by an external force.

SUMMARY OF THE INVENTION

In one aspect of the present invention, a mailbox post for supporting a mailbox in an upright orientation above a ground surface is disclosed. The mailbox post includes an upper length supporting the mailbox and a lower length for securement in the ground surface. A spring element is interposed between the upper length and the lower length proximal to the ground surface when the post is secured in the ground, such that the upper post is flexibly coupled to the lower post.

In some embodiments, a hollow opening is defined in an end of each of the upper length and the lower length. A coupling sleeve is received within the hollow opening. A spring stub has a first end and a second end. The first end is dimensioned to be received within the coupling sleeve. The second end is dimensioned to be received within an end of the spring element. The coupling sleeve has an inner diameter that is dimensioned to receive a first end of a spring stub therein. A fastener extends through each of the coupling sleeve, the spring stub, and the post.

The second end of the spring stub has an outer diameter that is dimensioned to be received within an inner diameter of the spring element. The second ends of opposed spring stubs terminate in a spaced apart relation defining a flex gap within the spring element. The flex gap is dimensioned to permit the spring element to flex about a vertical axis of the spring element. Preferably, the flex gap is dimensioned so that the spring element is configured to flex by at least as 90 degrees.

In some embodiments, a clamp bracket having a cross piece and distending legs at opposite ends of the clamp bracket. The distending legs are preferably spaced apart to extend around adjacent winds of the spring element. More preferably, the distending legs have a length corresponding to a diameter of the winds of the spring element.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, embodiments of the present invention provide an indestructible mailbox post that flexibly supports a mailbox via a spring element. The spring element allows an upper length of the post to pivot about a lower post element when-a force acts upon the upper length of the post. By way of non-limiting example, the force may be a vehicle backing into the post, or a pile of snow that is plowed against the post.

Figure 2:
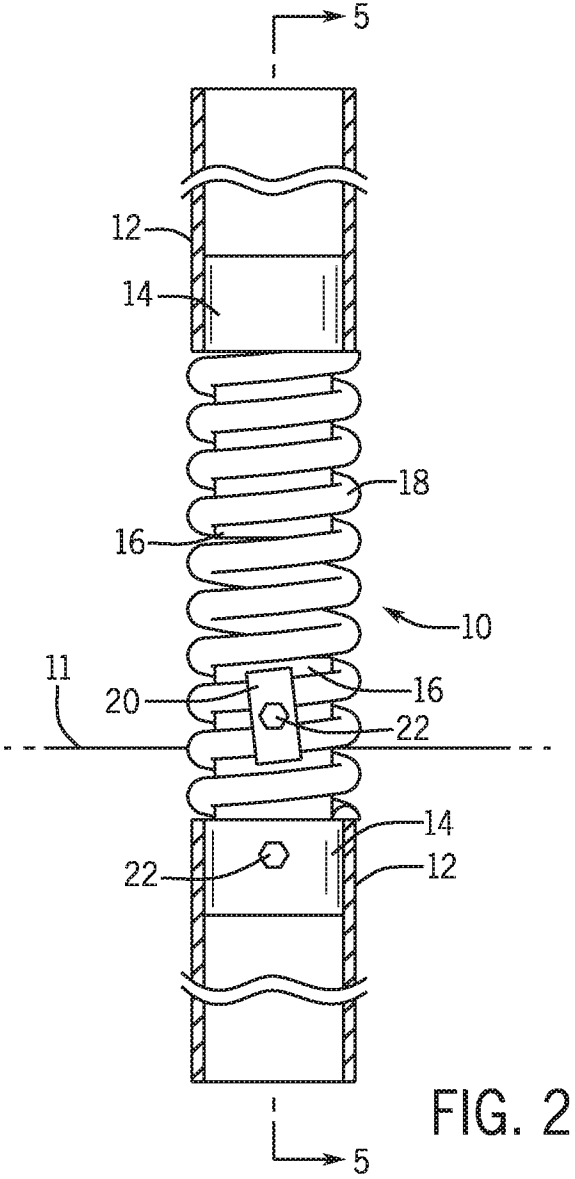
FIG. 2 is a front elevation view of the indestructible mailbox post.
Figure 1:
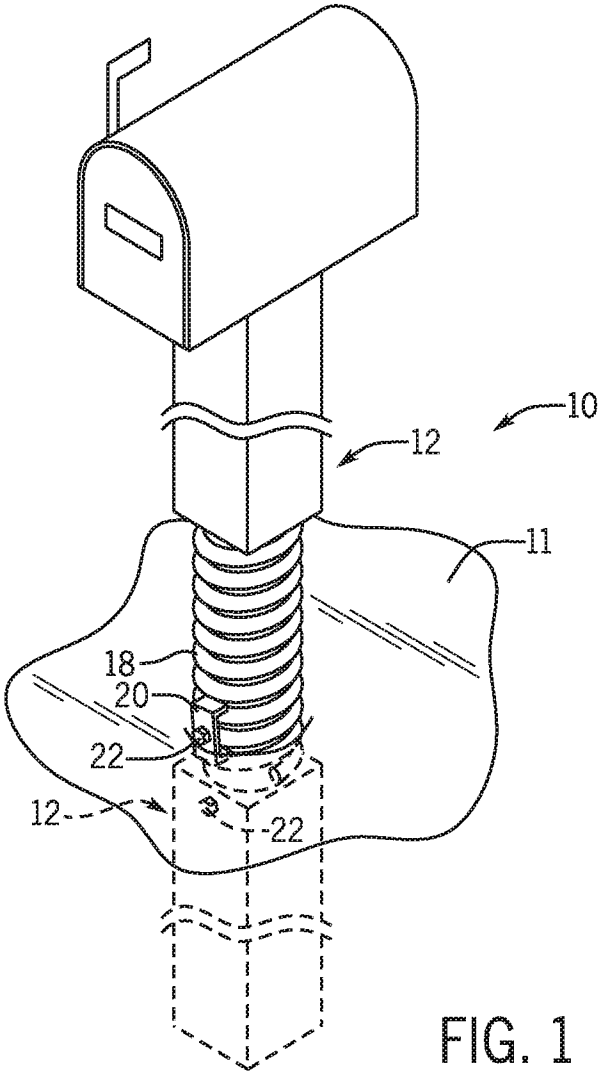
FIG. 1 is a perspective view of the indestructible mailbox post in use.
Figure 5:
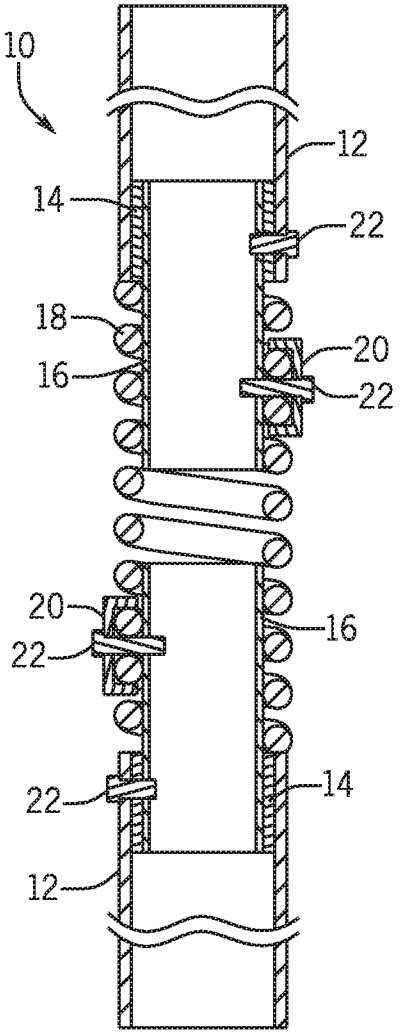
FIG. 5 is a cross-sectional view indicated by the line 5-5 of FIG. 2.
Figure 4:
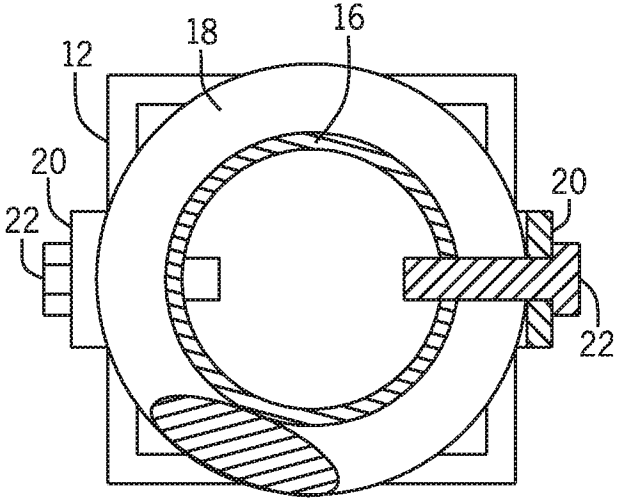
FIG. 4 is a cross sectional view of the indestructible mailbox post taken along line 4-4 of FIG. 3.
Figure 3:
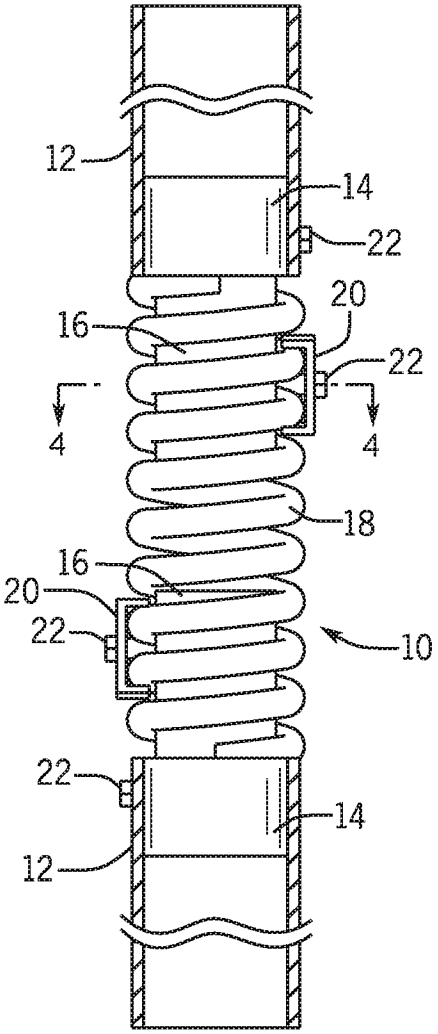
FIG. 3 is a side elevation view of the indestructible mailbox post.

As seen in reference to the drawings of FIGS. 1-5, the indestructible mailbox post 10 includes a post 12 to support a mailbox in an upright orientation above a ground surface 11. The post 12 includes an upper length and a lower length with a spring 18 interposed between the upper length and the lower length proximal to the ground surface. The post 12 may be formed from a solid or hollow structural material, such as wood, steel, PVC, or composites.

The post 12 has a hollow opening in each of the upper length and the lower length that is adapted to receive a coupling sleeve 14 therein. The coupling sleeve 14 has an inner diameter that is dimensioned to receive a first end of a spring stub 16 therein. The coupling sleeve 14 and spring stub 16 are secured to the post 12 via a fastener 22, such as a bolt, rivet, pin, or screw that extends through each of the coupling sleeve 14, the spring stub 16 and the post 12.

A second end of the spring stub 16 has an outer diameter that is dimensioned to be received within an inner diameter of the spring stub 18. The second ends of opposed spring stubs 16 terminate in a spaced apart relation defining a flex gap within the spring element 18 that is dimensioned to permit the spring element 18 to flex about a vertical axis of the spring element 18, preferably by at least as 90 degrees.

The second ends of the spring stub 16 are secured to the spring element 18 via a clamp bracket 20 and a fastener 22. The clamp bracket 20 has a cross piece and distending legs at opposite ends of the clamp bracket 20. The distending legs are spaced apart to extend around adjacent winds of the spring element 18. The distending legs have a length corresponding to a diameter of the winds of the spring element 18 so that the winds are clamped to the second ends of the spring stub 16.

In use, the lower post 12 is buried in the ground surface 11 and may be secured in the ground 11 with a concrete or other material. The lower post is buried to a depth such that the spring element 18 is positioned proximal, preferably slightly above the ground surface 11. With the upper post 12 coupled to the lower post 12 via the spring element 18 the upper post 12 is free to flex about the spring element 18 when acted upon by a force to preclude breakage of the post 12.

It should be understood, of course, that the foregoing relates to exemplary embodiments of the invention and that modifications may be made without departing from the spirit and scope of the invention as set forth in the following claims.

What is claimed is:

1. A mailbox post for supporting a mailbox in an upright orientation above a ground surface, comprising:

a post having an upper length capable of supporting the mailbox and a lower length for securement in the ground surface, a hollow opening in an end of each of the upper length and the lower length;

a coupling sleeve received within each hollow opening an upper spring stub having a cylindrical cross section with a first end received within the coupling sleeve of the upper length, a lower spring stub having a cylindrical cross section with a first end received within the coupling sleeve of the lower length, and a spring element receiving a second end of the upper spring stub and a second end of the lower spring stub such that the spring element abuts a corresponding upper length and lower length, the spring element interposed between the upper length and the lower length proximal to the ground surface when the lower length of the post is secured in the ground.

2. The mailbox post of claim 1, further comprising:

a fastener that extends through each of the coupling sleeve, the spring stub, and the post.

3. The mailbox post of claim 1 wherein each of the upper spring stub and the lower spring stub have an outer diameter that is dimensioned to be received within an inner diameter of the spring element.

4. The mailbox post of claim 3, wherein the second end of each of the upper spring stub and the lower spring stub terminate in a spaced apart relation defining a flex gap within the spring element.

5. The mailbox post of claim 4, wherein the flex gap is dimensioned to permit the spring element to flex about a vertical axis of the spring element.

6. The mailbox post of claim 5, wherein the spring element is configured to flex by at least 90 degrees.

7. The mailbox post of claim 6, further comprising:

a clamp bracket having a cross piece and distending legs at opposite ends of the clamp bracket.

8. The mailbox post of claim 7, wherein the distending legs are spaced apart to extend around adjacent winds of the spring element.

9. The mailbox post of claim 8, wherein the distending legs have a length corresponding to a diameter of the winds of the spring element.

10. A mailbox flexibly supported on a post, comprising:

a post having an upper length supporting a mailbox and a lower length for securement by a ground surface, a hollow opening in an end of each of the upper length and the lower length at;

a coupling sleeve received within each hollow opening;

an upper spring stub having a uniform cylindrical cross section along a longitudinal length of the upper spring stub, a first end of the upper spring stub received within the coupling sleeve of the upper length, a lower spring stub having a uniform cylindrical cross section along a longitudinal length of the lower spring stub, a first end of the lower spring stub received within the coupling sleeve of the lower length, a second end of each of the upper spring stub and the lower spring stub is received within a spring element interposed between the upper spring stub and the lower spring stub; and the spring element attached to the second end of each spring stub such that the spring element is positioned proximal to the ground surface when the lower length of the post is secured in the ground.

* * * * *